US010737832B2

(12) United States Patent
Apps et al.

(10) Patent No.: US 10,737,832 B2
(45) Date of Patent: Aug. 11, 2020

(54) HALF PALLET

(71) Applicant: Rehrig Pacific Company, Los Angeles, CA (US)

(72) Inventors: William P. Apps, Alpharetta, GA (US); Mariel Rezende, Potomac, MD (US); Brian Robert Guerry, Huntington Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 16/376,488

(22) Filed: Apr. 5, 2019

(65) Prior Publication Data

US 2019/0308769 A1 Oct. 10, 2019

Related U.S. Application Data

(60) Provisional application No. 62/652,997, filed on Apr. 5, 2018.

(51) Int. Cl.
*B65D 19/00* (2006.01)

(52) U.S. Cl.
CPC .. *B65D 19/004* (2013.01); *B65D 2519/00034* (2013.01); *B65D 2519/00069* (2013.01); *B65D 2519/00273* (2013.01); *B65D 2519/00771* (2013.01)

(58) Field of Classification Search
CPC ..... B65D 19/0012; B65D 2519/00268; B65D 2519/00288; B65D 2519/00034; B65D 2519/00318; B65D 2519/00069; B65D 2519/0094; B65D 2519/00338; B65D 2519/00935; B65D 2519/00955; B65D 2519/00956; B65D 19/004; B65D 2519/00273; B65D 2519/00771
See application file for complete search history.

(56) References Cited

U.S. PATENT DOCUMENTS 3,392,800 A * 7/1968 Swamy ..... B60V 1/04 180/125
3,977,333 A * 8/1976 Phillips ..... B65D 19/0073 108/54.1
4,051,787 A * 10/1977 Nishitani ..... B65D 19/0012 108/55.3
4,456,142 A * 6/1984 Burling ..... B65D 11/1873 100/265
4,801,024 A 1/1989 Flum et al.
5,341,748 A 8/1994 Liu
(Continued)

FOREIGN PATENT DOCUMENTS

JP 6179448 6/1994

*Primary Examiner* — Hanh V Tran
(74) *Attorney, Agent, or Firm* — Carlson, Gaskey & Olds, P.C.

(57) ABSTRACT

A half pallet includes a deck having opposite front and rear edges and opposite end edges. The end edges are shorter than the front and rear edges. End supports below the deck are adjacent end edges of the deck. The deck extends forward and rearward of the end supports. Each of the end supports includes a front edge recessed from the front edge of the deck and a rear edge recessed from the rear edge of the deck. Each end support prevents entry of a fork tine between the front edge of the end support and the rear edge of the end support.

19 Claims, 9 Drawing Sheets

(56) References Cited

U.S. PATENT DOCUMENTS 5,492,240 A * 2/1996 Vilutis ..... A01J 25/12 220/62.11
5,664,934 A 9/1997 Schaede et al.
5,816,425 A * 10/1998 Keip ..... B65D 11/1873 220/4.31
D400,681 S 11/1998 Sadr
6,216,608 B1 * 4/2001 Woods ..... B65D 19/0012 108/56.1
6,626,634 B2 6/2003 Hwang et al.
6,612,247 B1 * 9/2003 Pistner ..... B65D 19/0012 108/51.3
D548,924 S 8/2007 Frankenberg
7,293,509 B2 11/2007 Hassell
7,735,429 B2 6/2010 Meissen
7,819,068 B2 10/2010 Apps et al.
7,856,932 B2 12/2010 Stahl et al.
7,987,797 B2 8/2011 Stahl et al.
8,082,858 B2 * 12/2011 Yoshizawa ..... B65D 85/48 108/53.1
8,282,111 B2 10/2012 Hailston et al.
8,291,839 B2 10/2012 Apps et al.
8,776,697 B1 7/2014 O'Connell
8,894,076 B2 11/2014 Hailston et al.
D729,488 S 5/2015 Pulskamp et al.
9,027,487 B1 5/2015 O'Connell
9,611,071 B2 4/2017 Baltz et al.
9,950,828 B2 * 4/2018 Fujio ..... B65D 21/0212
2001/0041131 A1 * 11/2001 Hwang ..... B60P 3/055 414/800
2003/0110990 A1 * 6/2003 Apps ..... B65D 19/0016 108/57.25
2006/0162624 A1 7/2006 Hassell
2006/0175224 A1 * 8/2006 Wilcox ..... A01J 25/13 206/508
2006/0272556 A1 * 12/2006 Apps ..... B65D 19/004 108/53.1
2007/0028814 A1 * 2/2007 Swistak ..... B65D 19/0004 108/51.11
2007/0210542 A1 9/2007 Hammond
2007/0272640 A1 11/2007 Garcia
2008/0149005 A1 * 6/2008 Stahl ..... B65D 19/004 108/53.3
2009/0050030 A1 2/2009 Apps et al.
2009/0145339 A1 * 6/2009 Dubois ..... B65D 19/0002 108/56.1
2009/0183655 A1 * 7/2009 Ogburn ..... B65D 19/0016 108/57.25
2010/0084297 A1 * 4/2010 Apps ..... B65D 1/243 206/427
2010/0095875 A1 4/2010 Hailston et al.
2010/0196134 A1 8/2010 Stahl et al.
2012/0319063 A1 12/2012 Hailston et al.
2013/0216339 A1 * 8/2013 Apps ..... A47B 81/007 414/304
2013/0223962 A1 8/2013 Ellington et al.
2014/0283713 A1 * 9/2014 Baltz ..... B65D 19/44 108/50.11
2015/0135999 A1 * 5/2015 Takyar ..... B65D 19/0018 108/53.3
2015/0203138 A1 * 7/2015 Hassell ..... B62B 3/04 280/47.34
2015/0225215 A1 * 8/2015 King ..... B62B 3/0606 254/8 R
2015/0274360 A1 * 10/2015 Dye ..... B65D 19/44 206/597
2016/0039600 A1 * 2/2016 Wilcox ..... B65D 7/24 220/4.28
2016/0185486 A1 * 6/2016 Baltz ..... A47F 3/14 206/600
2017/0190467 A1 * 7/2017 Clark ..... B65D 19/04
2017/0297765 A1 * 10/2017 Guerry ..... B65D 19/385
2017/0341810 A1 * 11/2017 Banik ..... B65D 21/02
2017/0341811 A1 * 11/2017 Guerry ..... B65D 1/34

* cited by examiner

HALF PALLET

BACKGROUND

Pallets are often used to move goods from a warehouse to a store. Pallets include a deck that holds the goods above the floor so that fork tines can enter the pallet below the deck to lift and move the loaded pallet.

Half pallets may be used to move goods when it is expected that the half pallets will be moved through narrow aisles or into coolers. Typically half pallets may have a deck with short edges approximately 18-26 inches, which is about half as wide as a full size pallet. The long edges of the deck of the half pallet are typically in the range of approximately 36-50 inches. Generally, two side-by-side half pallets occupy about the same floor space and have about the same deck surface as a single full size pallet. Two half pallets can carry the same amount of goods as a full size pallet, but split into smaller loads. The loaded half pallet can also fit below shelves on a store floor, for merchandizing directly from the half pallet.

SUMMARY

An example half pallet according to the present invention includes a deck having opposite front and rear edges and opposite end edges. The end edges are shorter than the front and rear edges. End supports below the deck are adjacent end edges of the deck. The deck extends forward and rearward of the end supports. Each of the end supports includes a front edge recessed from the front edge of the deck and a rear edge recessed from the rear edge of the deck. Each end support prevents entry of a fork tine between the front edge of the end support and the rear edge of the end support.

The deck may have cantilevered portions forward and rearward of the end supports. The cantilevered portions may extend approximately four inches forward and rearward of the end supports. The half pallet may further include a center support below the deck and between the end supports. The end columns may be flush with the end edges of the deck.

Optionally, the half pallet may further include at least one resilient grommet secured to a lower surface of the deck to increase friction between the pallet and the tines. The at least one resilient grommet may be secured to a lower surface of one of the cantilevered portions of the deck.

The example half pallet shown herein has a deck that is approximately 24 inches by approximately 40 inches.

DETAILED DESCRIPTION

Figure 1:
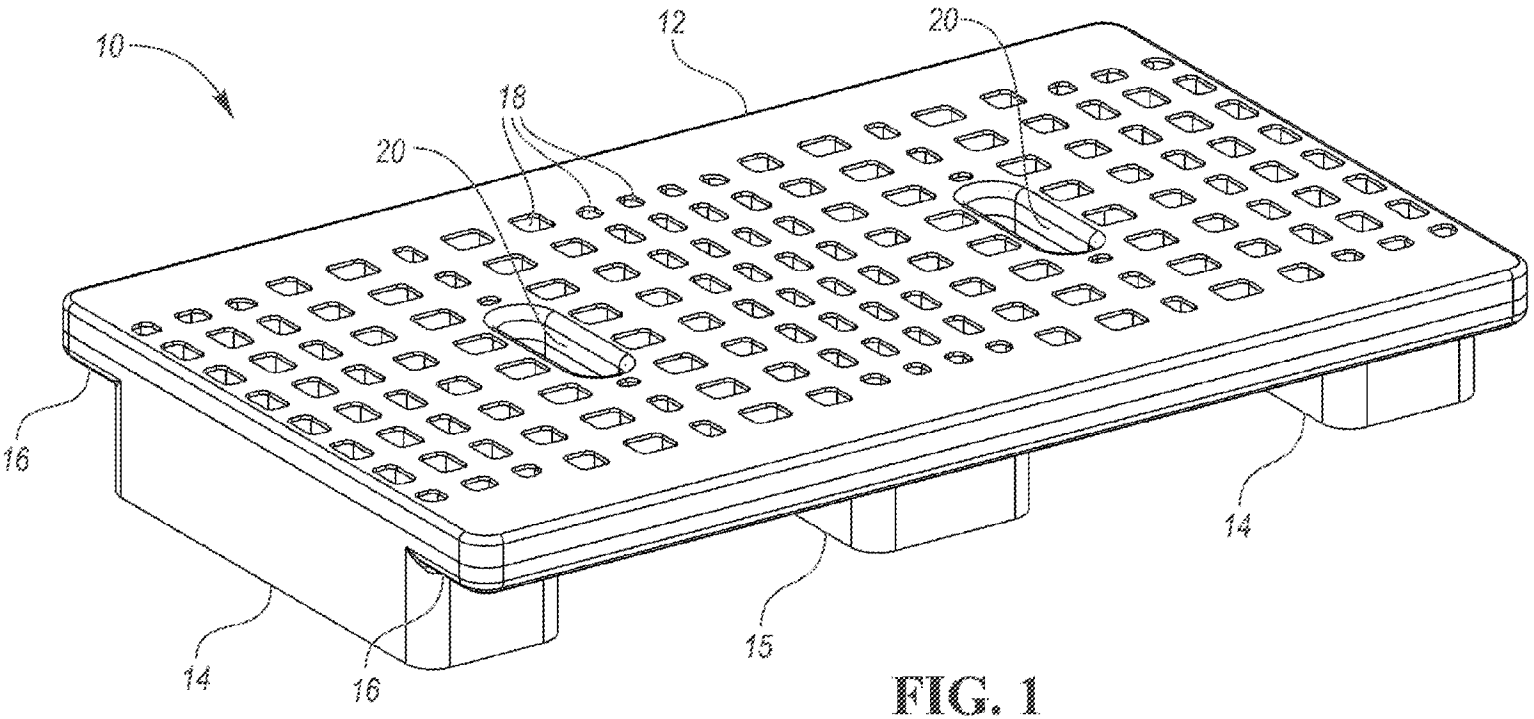
FIG. 1 is a perspective view of a half pallet according to an example embodiment.

FIG. 1 illustrates a half pallet 10 according to one embodiment. The half pallet 10 includes a deck 12 supported above the floor by a plurality of supports 14, 15. As a traditional, full-size pallet may have a deck that is approximately 48 by 40 inches, the half pallet 10 has a deck 12 that is approximately 24 by approximately 40 inches. The half pallet 10 could have a deck 12 of other dimensions, but is preferably in the range of a half pallet (i.e. the short sides being approximately 18 to 26 inches and the long sides being approximately 36 to 50 inches long, correspondingly).

As shown, the end supports 14 are flush with the ends or short sides of the deck 12. Alternatively, the end supports 14 could be recessed slightly (less than two inches) from the ends of the deck 12. The center support 15 is spaced equally between the end supports 14. The end supports 14 extend along a large majority of each end edge of the deck 12, leaving small cantilevered portions 16 of the deck 12 extending past the end supports 14 in forward and rearward directions. The outer wall of each end support 14 extends continuously from the deck 12 to the floor and from a front edge of the end support to a rear edge of the end support. Apertures or vents could be formed therein, but the end support should not permit entry of a fork tine.

The deck 12 includes a plurality of apertures 18 extending therethrough for drainage and to reduce the weight of the half pallet 10. The deck 12 also includes a pair of handle openings 20 therethrough. The handle openings 20 are centered between the front and rear edges of the deck 12 and are positioned between the center support 15 and each of the end supports 14.

Figure 2:
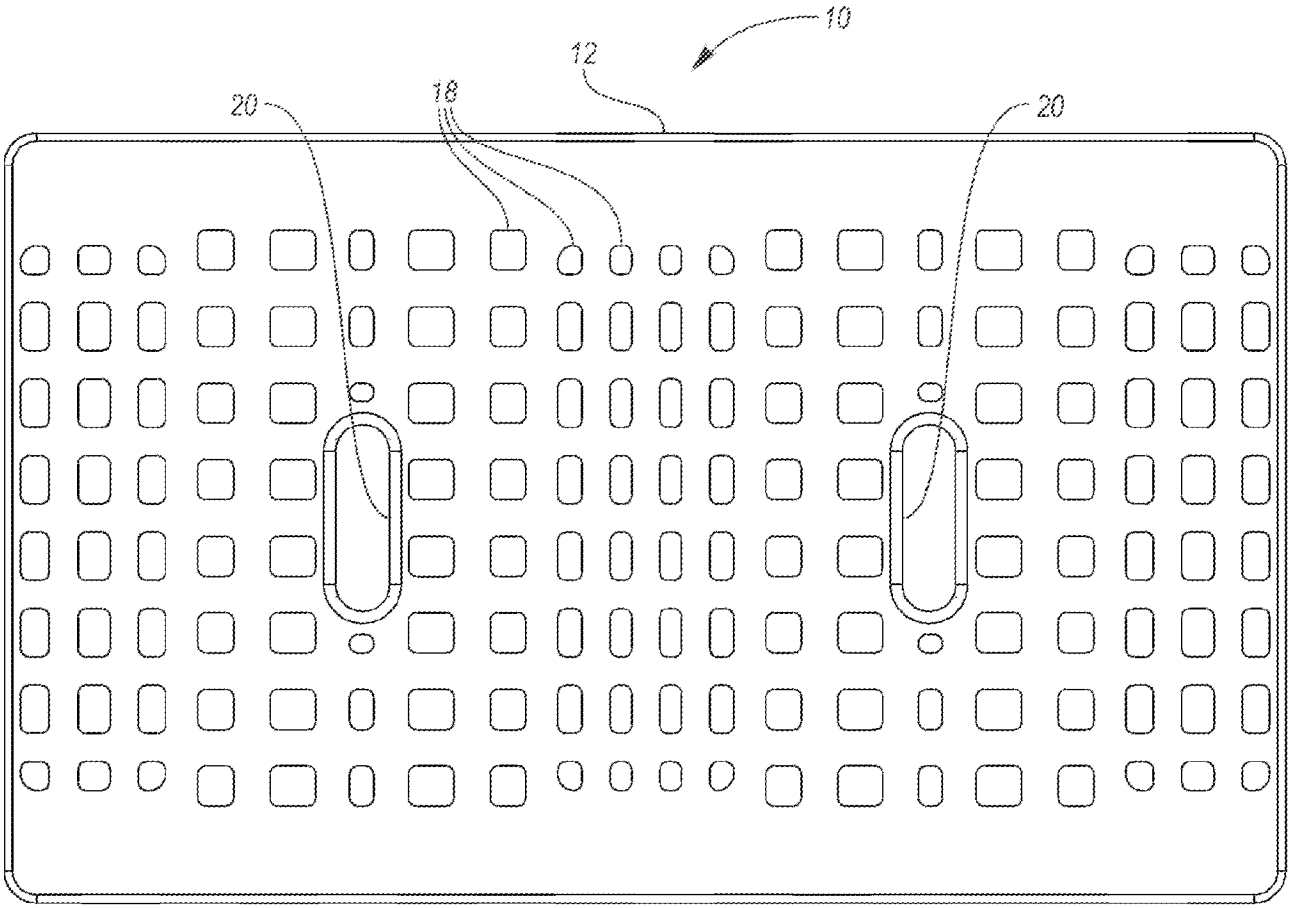
FIG. 2 is a top view of the half pallet of FIG. 1.

FIG. 2 is a top view of the half pallet 10.

Figure 3:
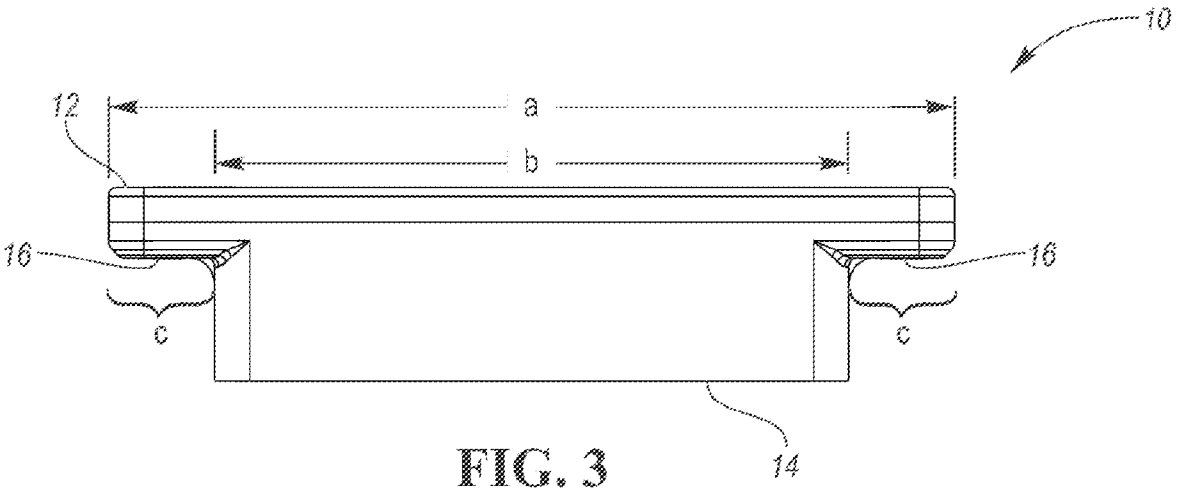
FIG. 3 is an end view of the half pallet of FIG. 1.

FIG. 3 is an end view of the half pallet 10. As shown, the deck 12 has a width a, which in this example is approximately 24 inches. Alternatively, the width a could be between 18 and 26 inches. The end support 14 is elongated in a direction generally parallel to the end edge of the deck 12 and has a length b which is less than the width a of the deck 12. The cantilevered portions 16 of the half pallet 10 have a width c, that represents the amount to which the width of the deck 12 exceeds the width of the supports 14 on each side. In this example, the widths c are approximately 4 inches each, so that the width b is approximately 16 inches.

Figure 4:
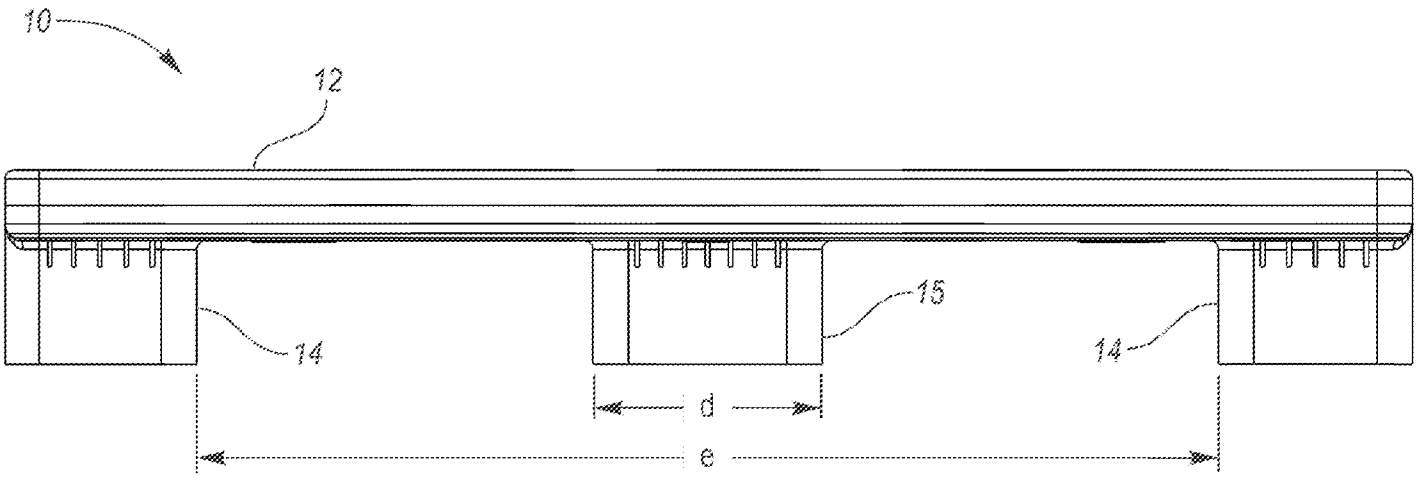
FIG. 4 is a front view of the half pallet of FIG. 1.

FIG. 4 is a front view of the half pallet 10. As shown, the center support 15 has a width d measured parallel to the long edge of the deck 12. In this example, the width d of the center support 15 is approximately 6.5 inches. Further, the distance e between the end supports 14 is approximately 29 inches. The space between the end supports 14 and center support 15 receives standard width fork tines of a hand pallet truck and slim width fork tines of a hand pallet truck.

Figure 5:
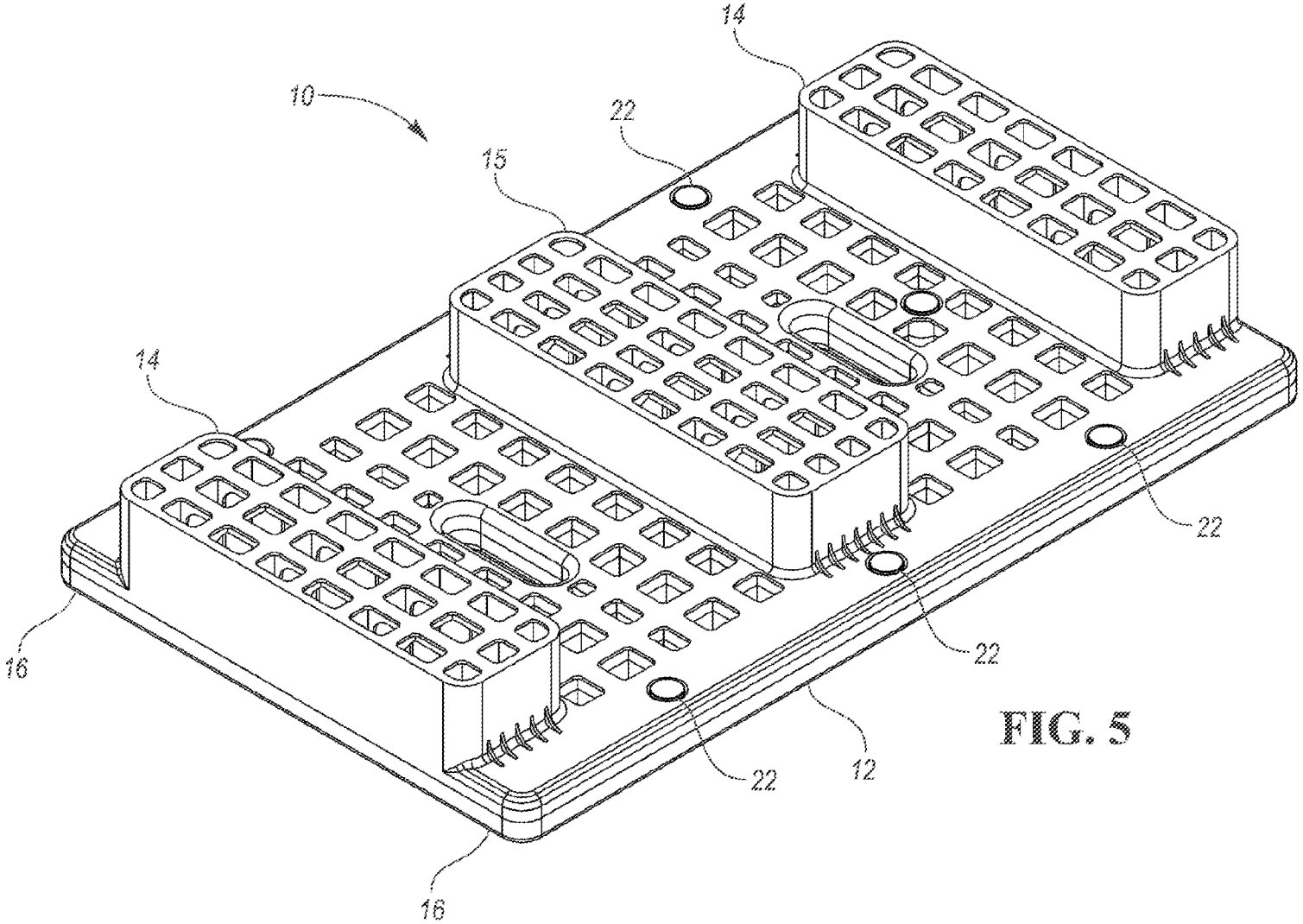
FIG. 5 is a bottom perspective view of the half pallet of FIG. 1.

FIG. 5 is a bottom perspective view of the half pallet 10. As shown, a plurality of resilient grommets 22 are secured to the lower surface of the deck 12. In this example, three of the resilient grommets 22 are secured to the lower surface of the deck 12 in each of the cantilevered portions 16. The resilient grommets 22 may be rubber or a resilient plastic that provides increased friction.

Figure 6:
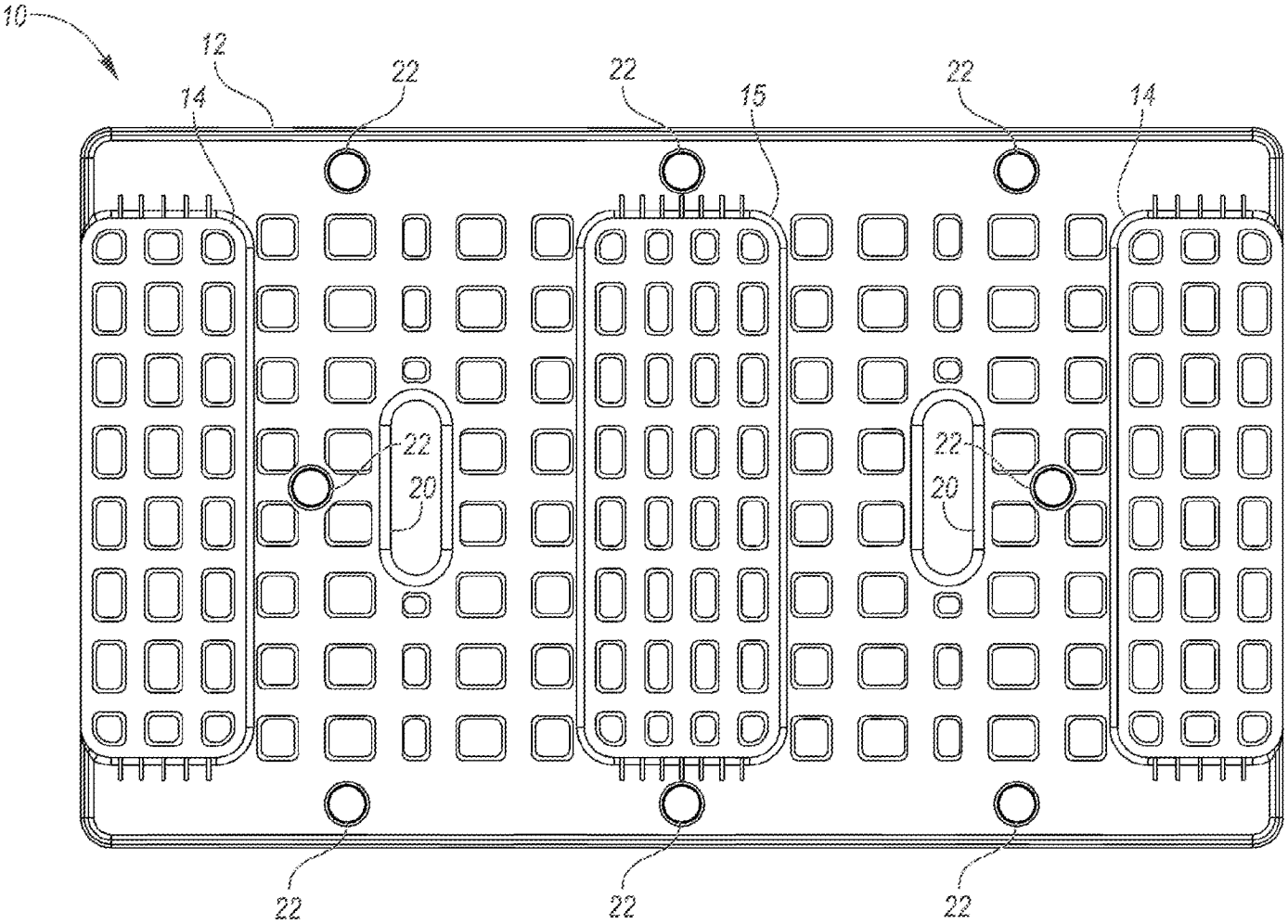
FIG. 6 is a bottom view of the half pallet of FIG. 1.

FIG. 6 is a bottom view of half pallet 10. As shown, additional resilient grommets 22 are secured to the lower surface of the deck 12 between each end support 14 and the center support 15. More specifically, the additional resilient grommets 22 are between each handle 20 and the nearer end support 14.

Figure 7:
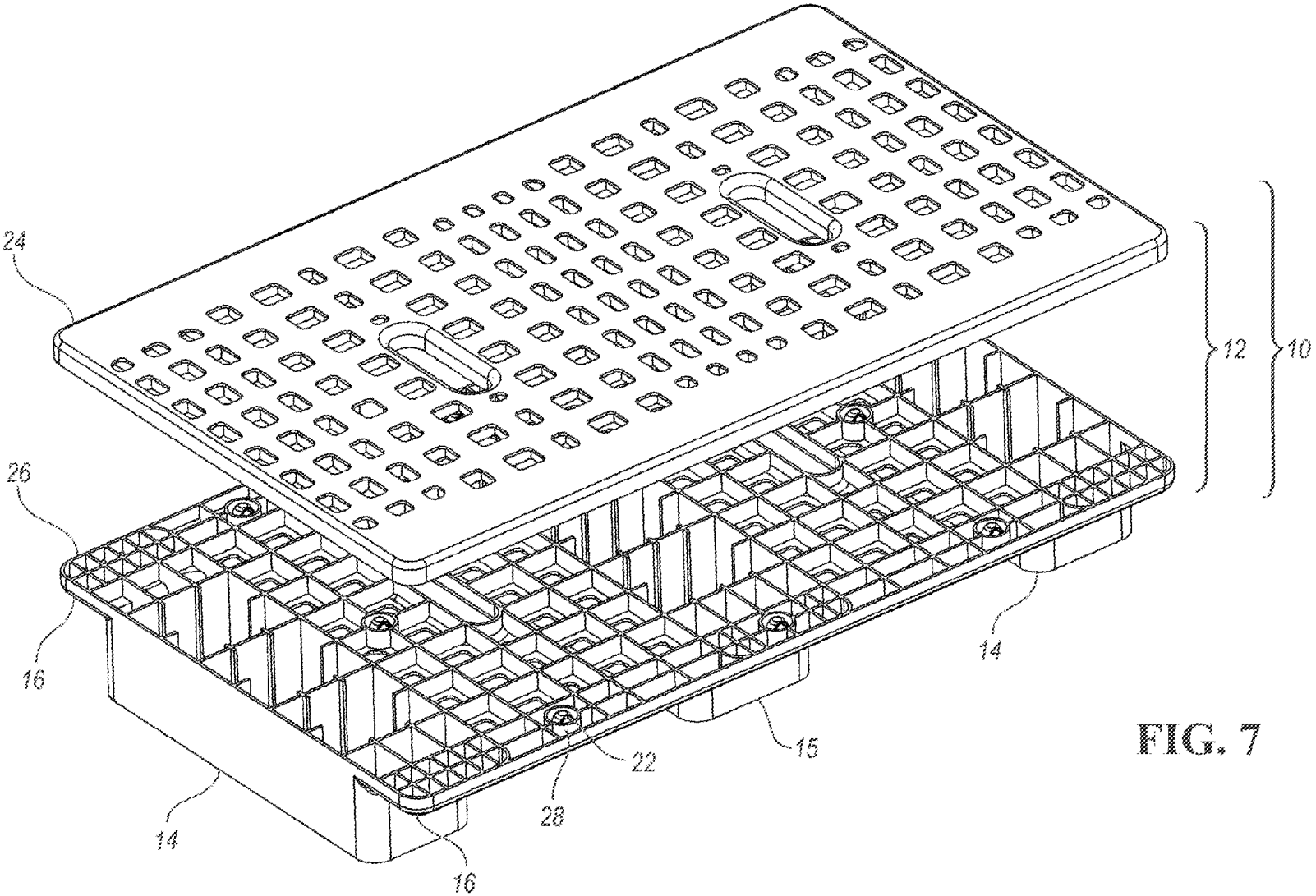
FIG. 7 is an exploded view of the half pallet of FIG. 1.

FIG. 7 is an exploded view of the half pallet 10. The deck 12 includes an upper deck portion 24 including an upper planar portion with ribs projecting downwardly therefrom. The deck 12 further includes a lower deck portion 26 including a lower planar portion having ribs projecting upwardly therefrom. The lower deck portion 26 includes a plurality of annular ribs 28 into which the resilient grommets 22 are a snap fit or otherwise secured. The upper deck portion 24 is integrally molded as a single piece of suitable plastic. The lower deck portion 26 is integrally molded with the supports 14, 15 as a single piece of suitable plastic. The upper deck portion 24 can be joined to the lower deck portion 26 by hot plate welding, vibration welding, sonic welding, adhesive, snap-fit connections, or other suitable techniques. Alternatively, the entire half pallet 10 may be integrally molded as a single piece of suitable plastic.

Figure 8:
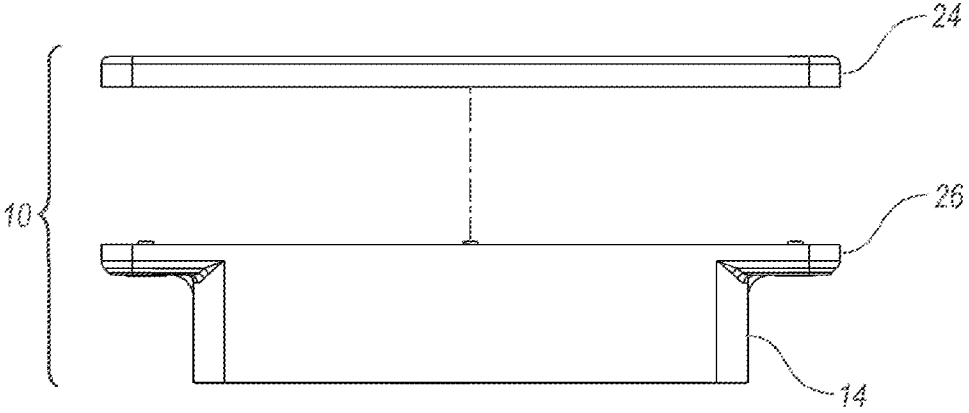
FIG. 8 is an end view of the exploded half pallet of FIG. 7.
Figure 9:
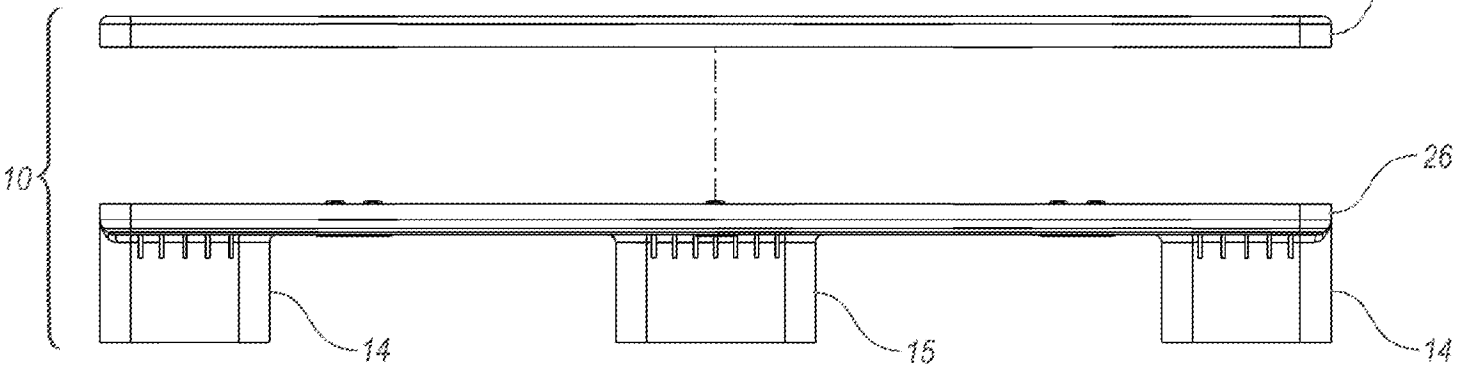
FIG. 9 is a front view of the exploded half pallet of FIG. 7.

FIG. 8 is an end exploded view of the half pallet 10, including the upper deck portion 24 and the lower deck portion 26. FIG. 9 is a front exploded view of the half pallet 10, including the upper deck portion 24 and the lower deck portion 26.

Figure 10:
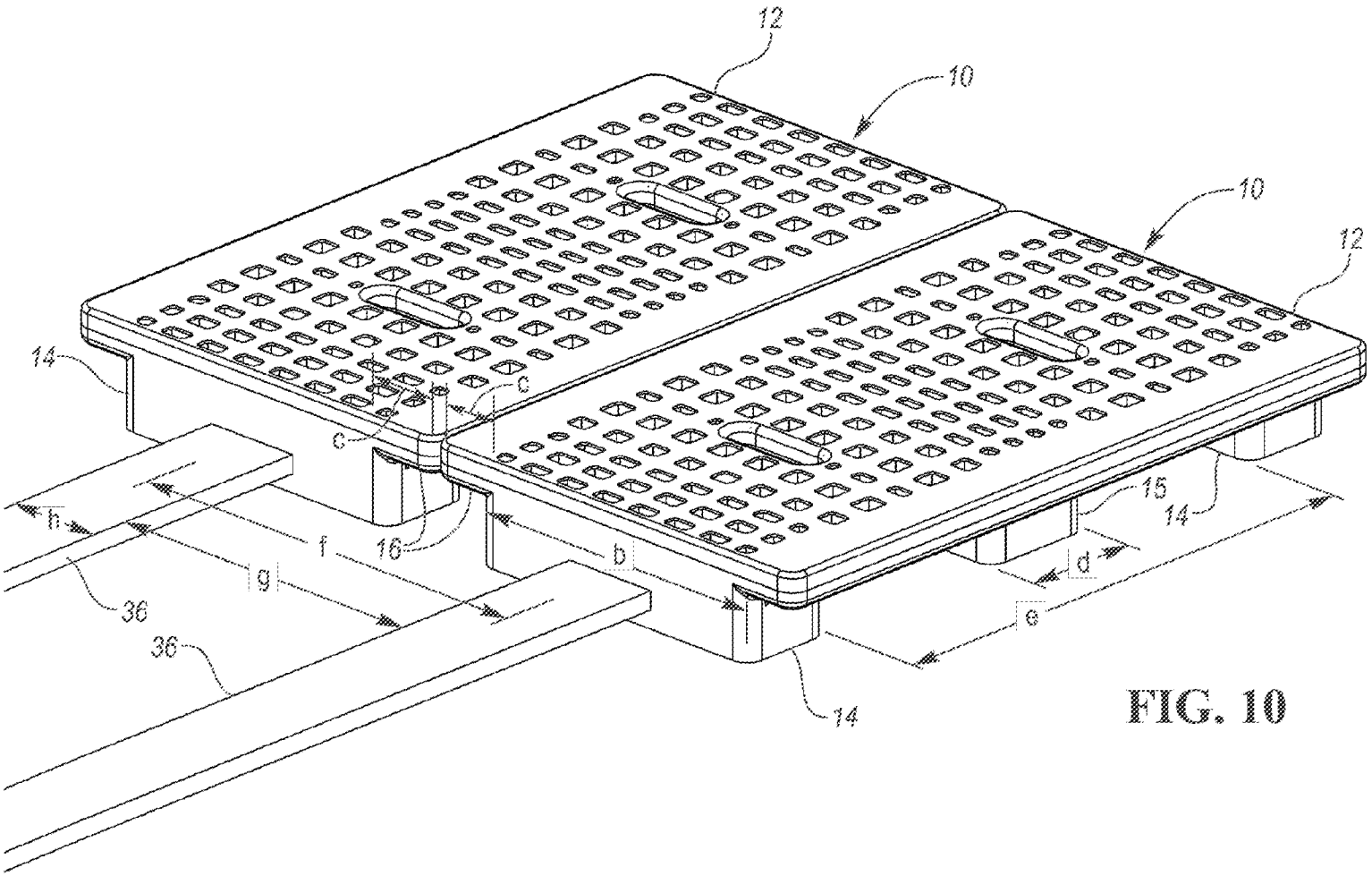
FIG. 10 shows a pair of half pallets of FIG. 1 with their decks abutting along their long edges.

FIG. 10 shows a pair of half pallets 10 with their decks 12 abutting along long edges. As illustrated, a pair of fork tines 36 of a forklift have a traditional fork tine center-to-center spacing f (i.e. approximately 28 inches) and have a distance g (less than approximately 16 inches) between the tines 36. The fork tines 36 are prevented by the design of the half pallets 10 from being used to lift two of the half pallets 10 from the ends thereof. Each tine 36 has a width h. The length b of the end supports 14 is larger than the distance g between the fork tines 36. Also, the width h of each fork tine 36 is larger than twice the distance c of the cantilevered portion 16 of the deck 12, so that the tines 36 cannot fit between the half pallets 10.

The traditional fork tines 36 can be used to lift the pallets 10 from the long sides (or front and back), as the distance g between the tines 36 is larger than the width d of the center support 15 and the outer dimensions of the fork tines 36 (g+2h) is less than distance e between the end supports 14. The resilient grommets 22 (FIG. 6) provide additional friction when the fork tines 36 lift the half pallets 10 from the front.

Figure 11:
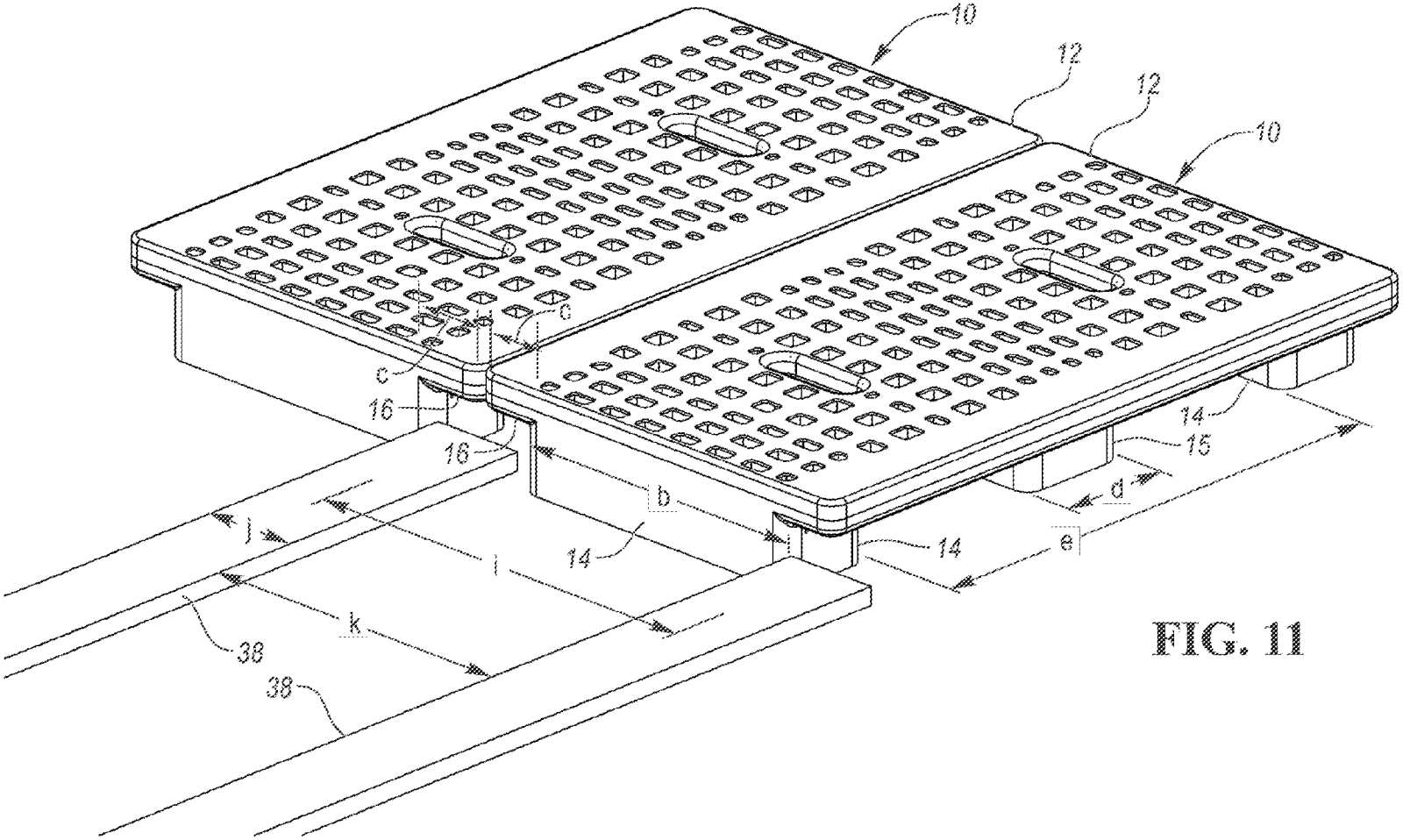
FIG. 11 shows the two pallets of FIG. 10 being engaged by a hand pallet truck.

FIG. 11 shows the two pallets 10 being engaged by a hand pallet truck having tines 38 with a center-to-center distance i. Each tine 38 has a width j and the tines 38 are spaced apart by a distance k. As shown, the width j of each tine 38 is less than twice the width c of the cantilevered portions 16 of the deck 12. The distance k between the tines 38 is greater than the length b of the end supports 14. The hand pallet truck with tines 38 can be used to lift one of the half pallets 10 from the end. The resilient grommets 22 (FIG. 6) provide additional friction when the fork tines 38 lift the half pallet 10 from the end.

The tines 38 can also be used to engage the half pallets 10 from the front along long edges. The distance k between the tines 38 is greater than the width d of the center support 15 and the outer dimensions of tines 38 (k+2j) is less than the distance e between the end supports 14. The resilient grommets 22 (FIG. 6) provide additional friction when the fork tines 38 lift the half pallets 10 from the front.

The design of the half pallet 10 prohibits the use of a fork lift with traditional tine spacing from trying to lift two half pallets 10 from the ends (or short sides). A hand truck with smaller tines can be used to lift a single half pallet 10 from the end. Either a fork lift or a hand truck can be used to lift the half pallets 10 from the front (or long sides).

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. "Approximately" herein means plus or minus up to and including one inch, unless otherwise specified. Indications that one dimension is larger or smaller than another take precedence over approximate dimensions.

What is claimed is:

1. A half pallet comprising:

a deck having opposite front and rear edges and opposite end edges, wherein the end edges are shorter than the front and rear edges; and end supports below the deck adjacent end edges of the deck, each end support having an outer wall extending continuously from a front edge to a rear edge of each end support, wherein the deck has cantilevered portions forward and rearward of the end supports and wherein the cantilevered portions extend approximately four inches forward and rearward of the end supports.

2. The half pallet of claim 1 wherein each of the end supports includes the front edge recessed from the front edge of the deck and the rear recessed from the rear edge of the deck.

3. The half pallet of claim 2 wherein each end support prevents entry of a fork tine between the front edge of the end support and the rear edge of the end support.

4. The half pallet of claim 1 further including a center support below the deck and between the end supports.

5. The half pallet of claim 4 further including at least one resilient grommet secured to a lower surface of one of the cantilevered portions of the deck.

6. The half pallet of claim 4 wherein the end edges of the deck are approximately 18-26 inches and the front and rear edges of the deck are approximately 36-50 inches.

7. The half pallet of claim 4 wherein the deck is approximately 24 inches by approximately 40 inches.

8. The half pallet of claim 7 wherein the deck includes an upper deck portion including an upper planar portion with ribs projecting downwardly therefrom, and wherein the deck further includes a lower deck portion including a lower planar portion with ribs projecting upwardly therefrom, wherein the ribs of the upper deck portion are joined to the ribs of the lower deck portion, wherein the lower deck portion is integrally molded with the end supports and the center support.

9. The half pallet of claim 8 wherein the deck further includes a handle opening centered between the front edge and the rear edge, wherein the handle opening is positioned between the center support and one of the end supports.

10. The half pallet of claim 7 wherein a distance from the front edge of the end support to the rear edge of the end support is approximately 16 inches.

11. The half pallet of claim 10 in combination with a pair of tines spaced apart from one another by a distance smaller than the distance from the front edge of the end support to the rear edge of the end support.

12. The half pallet and pair of tines of claim 11 wherein the distance between the pair of tines is greater than a width of the center support such that the half pallet can be lifted by the pair of tines.

13. The half pallet of claim 1 further including at least one resilient grommet secured to a lower surface of the deck.

14. A half pallet comprising:

a deck having opposite front and rear edges and opposite end edges, wherein the end edges of the deck are approximately 18-26 inches and the front and rear edges of the deck are approximately 36-50 inches; and end supports below the deck adjacent end edges of the deck, wherein each of the end supports includes a front edge recessed from the front edge of the deck and a rear edge recessed from the rear edge of the deck, wherein each end support prevents entry of a fork tine between the front edge of the end support and the rear edge of the end support.

15. The half pallet of claim 14 further including a center support below the deck and between the end supports and wherein the deck has cantilevered portions forward and rearward of the end supports and of the center support and wherein the cantilevered portions extend approximately four inches forward and rearward of the end supports.

16. The half pallet of claim 15 wherein the deck is approximately 24 inches by approximately 40 inches.

17. The half pallet of claim 14 wherein the end supports are flush with the end edges of the deck.

18. In combination:

a pair of tines spaced apart from one another by a tine distance; and a half pallet comprising:

a deck having opposite front and rear edges and opposite end edges, wherein the end edges are shorter than the front and rear edges, wherein the deck is approximately 24 inches by approximately 40 inches;

end supports below the deck adjacent end edges of the deck, wherein the deck has cantilevered portions forward and rearward of the end supports and wherein the cantilevered portions extend approximately four inches forward and rearward of the end supports, wherein a distance from the front edge of each end support to the rear edge of each end support is approximately 16 inches, wherein the tine distance is smaller than the distance from the front edge of the end support to the rear edge of the end support; and a center support below the deck and between the end supports.

19. The half pallet and pair of tines of claim 18 wherein the tine distance is greater than a width of the center support such that the half pallet can be lifted by the pair of tines.

* * * * *